US009336653B2

(12) United States Patent
Harris et al.

(10) Patent No.: US 9,336,653 B2
(45) Date of Patent: May 10, 2016

(54) GAMING SYSTEM AND METHOD FOR PROVIDING A MULTIPLE PLAYER BONUS EVENT

(71) Applicant: IGT, Las Vegas, NV (US)

(72) Inventors: Casey Alexander Harris, Las Vegas, NV (US); Wei Zang, Beijing (CN)

(73) Assignee: IGT, Las Vegas, NV (US)

( * ) Notice: Subject to any disclaimer, the term of this patent is extended or adjusted under 35 U.S.C. 154(b) by 238 days.

(21) Appl. No.: 14/030,392

(22) Filed: Sep. 18, 2013

(65) Prior Publication Data

US 2015/0080118 A1 Mar. 19, 2015

(51) Int. Cl.
*A63F 9/24* (2006.01)
*G07F 17/32* (2006.01)

(52) U.S. Cl.
CPC ..... *G07F 17/3258* (2013.01); *G07F 17/3269* (2013.01)

(58) Field of Classification Search
CPC ..... G07F 17/3269; G07F 17/3258; G07F 17/3244; G07F 17/3246
USPC ..... 463/16–20, 40–42, 25
See application file for complete search history.

(56) References Cited

U.S. PATENT DOCUMENTS 4,837,728 A 6/1989 Barrie et al.
5,116,055 A 5/1992 Tracy
5,344,144 A 9/1994 Canon
5,417,430 A 5/1995 Breeding
5,477,952 A 12/1995 Castellano et al.
5,505,461 A 4/1996 Bell et al.
5,533,727 A 7/1996 DeMar
5,564,700 A 10/1996 Celona
5,569,082 A 10/1996 Kaye
5,580,309 A 12/1996 Piechowiak et al.
5,611,730 A 3/1997 Weiss
5,664,998 A 9/1997 Seelig et al.
5,681,040 A 10/1997 Peterson
5,743,798 A 4/1998 Adams et al.
5,752,882 A 5/1998 Acres
5,829,748 A 11/1998 Moore, Jr.
5,855,515 A 1/1999 Pease et al.
5,855,575 A 1/1999 Solomon et al.

(Continued)

FOREIGN PATENT DOCUMENTS

AU 9213023 3/1992
AU 704365 4/1997

(Continued)

*Primary Examiner* — Ronald Laneau
*Assistant Examiner* — Ross Williams
(74) *Attorney, Agent, or Firm* — Neal, Gerber & Eisenberg LLP

(57) ABSTRACT

A gaming system which includes a bonus event associated with a bonus event time period or bonus event time window. The bonus event utilizes a plurality of bonus event component sequences, wherein each bonus event component sequence is associated with a plurality of time periods or windows which collectively (when accounting for any overlaps) forms the bonus event time period. In these embodiments, upon the triggering of the bonus event, the gaming system provides one or more awards in association with each bonus event component sequence. That is, for the single occurrence of a bonus event triggering event, the gaming system determines a plurality of winners for a plurality of different time periods that are each associated with the bonus event.

20 Claims, 7 Drawing Sheets

(56) References Cited

U.S. PATENT DOCUMENTS

| | | | |
|---|---|---|---|
| 5,885,158 | A | 3/1999 | Torango et al. |
| 5,984,779 | A | 11/1999 | Bridgeman et al. |
| 6,017,032 | A | 1/2000 | Grippo et al. |
| 6,089,980 | A | 7/2000 | Gauselmann |
| 6,102,799 | A | 8/2000 | Stupak |
| 6,146,273 | A | 11/2000 | Olsen |
| 6,168,521 | B1 | 1/2001 | Luciano et al. |
| 6,210,277 | B1 | 4/2001 | Stefan |
| 6,231,445 | B1 | 5/2001 | Acres |
| 6,238,288 | B1 | 5/2001 | Walker et al. |
| 6,254,483 | B1 | 7/2001 | Acres |
| 6,296,569 | B1 | 10/2001 | Congello, Jr. |
| 6,364,768 | B1 | 4/2002 | Acres et al. |
| 6,375,569 | B1 | 4/2002 | Acres |
| 6,565,434 | B1 | 5/2003 | Acres |
| 6,607,438 | B2 | 8/2003 | Baerlocher et al. |
| 6,726,563 | B1 | 4/2004 | Baerlocher et al. |
| 6,780,105 | B1 | 8/2004 | Kaminkow |
| 6,800,030 | B2 | 10/2004 | Acres |
| 6,814,664 | B2 | 11/2004 | Baerlocher et al. |
| 6,887,154 | B1 | 5/2005 | Luciano, Jr. et al. |
| 6,899,625 | B2 | 5/2005 | Luciano, Jr. et al. |
| 7,033,270 | B2 | 4/2006 | Baerlocher et al. |
| 7,086,950 | B2 | 8/2006 | Gordon et al. |
| 7,121,943 | B2 | 10/2006 | Webb et al. |
| 7,223,172 | B2 | 5/2007 | Baerlocher et al. |
| 7,311,598 | B2 | 12/2007 | Kaminkow et al. |
| 7,311,604 | B2 | 12/2007 | Kaminkow et al. |
| 7,351,140 | B2 | 4/2008 | Wolf et al. |
| 7,364,510 | B2 | 4/2008 | Walker et al. |
| 7,427,236 | B2 | 9/2008 | Kaminkow et al. |
| 7,448,949 | B2 | 11/2008 | Kaminkow et al. |
| 7,452,270 | B2 | 11/2008 | Walker et al. |
| 7,470,187 | B2 | 12/2008 | Baerlocher et al. |
| 7,470,188 | B2 | 12/2008 | Baerlocher et al. |
| 7,470,189 | B2 | 12/2008 | Baerlocher et al. |
| 7,470,190 | B2 | 12/2008 | Baerlocher et al. |
| 7,481,430 | B1 | 1/2009 | Jackson et al. |
| 7,785,194 | B2 | 8/2010 | Schneider et al. |
| 7,854,654 | B2 | 12/2010 | Baerlocher et al. |
| 8,070,593 | B2 | 12/2011 | DeWaal et al. |
| 8,118,664 | B2 | 2/2012 | Johnson |
| 2001/0034260 | A1 | 10/2001 | Luciano, Jr. et al. |
| 2001/0049303 | A1 | 12/2001 | Found et al. |
| 2003/0100361 | A1 | 5/2003 | Sharpless et al. |
| 2003/0186733 | A1 | 10/2003 | Wolf et al. |
| 2004/0102238 | A1 | 5/2004 | Taylor |
| 2005/0043082 | A1 | 2/2005 | Peterson et al. |
| 2005/0187014 | A1 | 8/2005 | Saffari et al. |
| 2005/0218590 | A1 | 10/2005 | O'Halloran et al. |
| 2006/0025195 | A1 | 2/2006 | Pennington et al. |
| 2006/0025203 | A1 | 2/2006 | Thomas |
| 2006/0040723 | A1 | 2/2006 | Baerlocher et al. |
| 2006/0040732 | A1 | 2/2006 | Baerlocher et al. |
| 2006/0040733 | A1 | 2/2006 | Baerlocher et al. |
| 2006/0040734 | A1 | 2/2006 | Baerlocher et al. |
| 2006/0040736 | A1 | 2/2006 | Baerlocher et al. |
| 2006/0046821 | A1 | 3/2006 | Kaminkow et al. |
| 2006/0068876 | A1 | 3/2006 | Kane et al. |
| 2006/0073897 | A1 | 4/2006 | Englman et al. |
| 2006/0100019 | A1 | 5/2006 | Hornik et al. |
| 2006/0111178 | A1 | 5/2006 | Gallaway et al. |
| 2006/0135243 | A1 | 6/2006 | Englman et al. |
| 2006/0189376 | A1 | 8/2006 | Hornik et al. |
| 2006/0252481 | A1 | 11/2006 | Schmit |
| 2006/0287043 | A1 | 12/2006 | Englman et al. |
| 2007/0054732 | A1 | 3/2007 | Baerlocher |
| 2007/0054733 | A1 | 3/2007 | Baerlocher et al. |
| 2007/0060317 | A1 | 3/2007 | Martin |
| 2007/0060329 | A1 | 3/2007 | Martin |
| 2007/0060330 | A1 | 3/2007 | Martin |
| 2007/0060369 | A1 | 3/2007 | Martin |
| 2007/0077990 | A1 | 4/2007 | Cuddy et al. |
| 2007/0105619 | A1 | 5/2007 | Kniesteadt et al. |
| 2007/0105620 | A1 | 5/2007 | Cuddy et al. |
| 2007/0149292 | A1 | 6/2007 | Kaminkow et al. |
| 2007/0155465 | A1 | 7/2007 | Walker et al. |
| 2007/0155485 | A1 | 7/2007 | Cuddy et al. |
| 2007/0167217 | A1 | 7/2007 | Kaminkow et al. |
| 2008/0020817 | A1 | 1/2008 | Kaminkow et al. |
| 2008/0020822 | A1 | 1/2008 | Cuddy et al. |
| 2008/0020823 | A1 | 1/2008 | Cuddy et al. |
| 2008/0020824 | A1 | 1/2008 | Cuddy et al. |
| 2008/0020825 | A1 | 1/2008 | Cuddy et al. |
| 2008/0020829 | A1 | 1/2008 | Baerlocher |
| 2008/0020847 | A1 | 1/2008 | Kniesteadt et al. |
| 2008/0039194 | A1 | 2/2008 | Walther et al. |
| 2008/0045341 | A1 | 2/2008 | Englman |
| 2008/0051168 | A1 | 2/2008 | Kaminkow et al. |
| 2008/0070676 | A1 | 3/2008 | Baerlocher et al. |
| 2008/0070677 | A1 | 3/2008 | Baerlocher et al. |
| 2008/0070678 | A1 | 3/2008 | Baerlocher et al. |
| 2008/0070702 | A1 | 3/2008 | Kaminkow et al. |
| 2008/0076527 | A1* | 3/2008 | Low et al. ..... 463/25 |
| 2008/0081690 | A1 | 4/2008 | Baerlocher et al. |
| 2008/0081691 | A1 | 4/2008 | Baerlocher et al. |
| 2008/0102916 | A1 | 5/2008 | Kovacs et al. |
| 2008/0102920 | A1 | 5/2008 | Baerlocher |
| 2008/0108401 | A1 | 5/2008 | Baerlocher et al. |
| 2008/0108429 | A1 | 5/2008 | Davis et al. |
| 2008/0113765 | A1 | 5/2008 | DeWaal |
| 2008/0113768 | A1 | 5/2008 | Baerlocher |
| 2008/0113771 | A1 | 5/2008 | Baerlocher et al. |
| 2008/0119283 | A1 | 5/2008 | Baerlocher |
| 2008/0139274 | A1 | 6/2008 | Baerlocher et al. |
| 2008/0139290 | A1 | 6/2008 | Kniesteadt et al. |
| 2008/0153564 | A1 | 6/2008 | Baerlocher et al. |
| 2008/0161105 | A1 | 7/2008 | Mishra |
| 2008/0176630 | A1 | 7/2008 | Toyoda |
| 2008/0188296 | A1 | 8/2008 | Seelig et al. |
| 2008/0188298 | A1 | 8/2008 | Seelig et al. |
| 2008/0200239 | A1 | 8/2008 | Gilmore et al. |
| 2008/0293481 | A1 | 11/2008 | Davies |
| 2009/0036202 | A1 | 2/2009 | Baerlocher et al. |
| 2009/0042644 | A1 | 2/2009 | Zielinski |
| 2009/0042645 | A1 | 2/2009 | Graham et al. |
| 2009/0275410 | A1 | 11/2009 | Kisenwether et al. |

FOREIGN PATENT DOCUMENTS

| | | |
|---|---|---|
| AU | 697582 | 2/1998 |
| AU | 721968 | 6/1998 |
| AU | 757903 | 10/1998 |
| AU | 728788 | 7/1999 |
| AU | 753102 | 11/1999 |
| AU | 760617 | 1/2000 |
| AU | 754819 | 3/2000 |
| AU | 200030250 | 7/2000 |
| AU | 200053686 | 8/2000 |
| AU | 776008 | 10/2000 |
| EP | 0534718 | 3/1993 |
| EP | 0787026 | 7/1999 |
| GB | 2201279 | 8/1988 |
| WO | WO/99/03078 | 1/1999 |
| WO | WO/99/21630 | 5/1999 |
| WO | WO/00/22585 | 4/2000 |
| WO | WO/00/32286 | 6/2000 |
| WO | WO01/15790 | 3/2001 |
| WO | WO/2005/082480 | 9/2005 |
| WO | WO/2006/005073 | 1/2006 |
| WO | WO/2007/030733 | 3/2007 |
| WO | WO/2007/033000 | 3/2007 |
| WO | WO/2007/046074 | 4/2007 |
| WO | WO/2007/127259 | 11/2007 |
| WO | WO/2008/021449 | 2/2008 |
| WO | WO/2008/024330 | 2/2008 |
| WO | WO/2008/045398 | 4/2008 |
| WO | WO/2008/048634 | 4/2008 |
| WO | WO/2008/051796 | 5/2008 |
| WO | WO/2008/060978 | 5/2008 |

* cited by examiner

FIG. 3

| GAMING MACHINE | CREDITS WAGERED DURING BONUS AWARD INELIGIBILITY TIME PERIOD | CREDITS WAGERED DURING BONUS AWARD ELIGIBILITY TIME PERIOD | TOTAL CREDITS WAGERED DURING BONUS AWARD ELIGIBILTY TIME PERIOD | PROBABILITY OF BEING SELECTED |
|---|---|---|---|---|
| A | 95 | 220 | 440 | 50% |
| B | 275 | 154 | 440 | 35% |
| C | 135 | 33 | 440 | 15% |

GAMING SYSTEM AND METHOD FOR PROVIDING A MULTIPLE PLAYER BONUS EVENT

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards.

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Progressive awards associated with gaming machines are also known. In one form, a progressive award is an award amount which includes an initial amount funded by a casino and an additional amount funded through a portion of each wager made on the progressive gaming machine. For example, 0.1% of each wager placed on the primary game of the gaming machine associated with the progressive award may be allocated to the progressive award or progressive award fund or pool. The progressive award grows in value as more players play the gaming machines and more portions of these players wagers are allocated to the progressive award. When a progressive award triggering event occurs, such as when a player obtains a winning symbol combination associated with the progressive award or when the progressive award grows to a progressive award hit value, the accumulated progressive award is provided to the player. After the progressive award is provided to the player, the amount of the next progressive award is reset to the initial value and a portion of each subsequent wager on a gaming machine associated with the progressive award is allocated to the next progressive award.

While such progressive awards are popular amongst players, a number of issues exist with these known progressive award systems. First, only players currently playing gaming machines in the progressive award gaming system are typically eligible to win the progressive award. Typically, in such progressive award systems, the player who places the wager that caused the progressive award system to meet the specified criteria (such as an amount of coin-in) is awarded the progressive award. Thus, if a player stops playing for the progressive award, the player sacrifices their opportunity to win the progressive award and the progressive award may be provided to another player. This may discourage certain players from playing a gaming machine if they have a limited amount of time to play.

In one instance, certain players leave the gaming machines after realizing that the progressive award has been provided to another player. Such players may walk away from the gaming machines feeling discouraged. Such discouragement can lead to certain players walking away with jackpot fatigue. By walking away, even if the player has spent long periods of time playing for the progressive award, the player sacrifices or forfeits any opportunity to win the progressive award. This may lead to certain players feeling pessimistic about their chances to win the progressive award.

Other players may believe that a significant amount of time and money are required to win the progressive award. This may discourage certain players from playing a gaming machine, especially if those players have a limited amount of money to play with or a limited amount of time to play.

There is a continuing need to provide new and different gaming machines and gaming systems which addresses these issues as well as new and different ways to provide awards to players including progressive awards and other bonus awards.

SUMMARY

The present disclosure relates generally to gaming systems and methods for providing a plurality of awards to a plurality of players upon an occurrence of a bonus event.

In various embodiments, the gaming system disclosed herein includes a bonus event associated with a bonus event time period or bonus event time window. The bonus event utilizes a plurality of bonus event component sequences, wherein each bonus event component sequence is associated with a plurality of time periods or windows which collectively (when accounting for any overlaps) forms the bonus event time period. In these embodiments, upon the triggering of the bonus event, the gaming system provides one or more awards in association with each bonus event component sequence. That is, for the single occurrence of a bonus event triggering event, the gaming system determines a plurality of winners for a plurality of different time periods that are each associated with the bonus event. Such a configuration of providing a plurality of awards over a plurality of time periods based on a single occurrence of a triggering event combats jackpot fatigue and provides an increased amount of excitement and enjoyment for certain players.

More specifically, in certain embodiments, the gaming system enables a plurality of players at a plurality of electronic gaming machines to place one or more wagers on one or more games. In these embodiments, upon an occurrence of a bonus event triggering condition, the gaming system triggers a bonus event. In certain embodiments, a bonus event triggering condition is satisfied independent of any displayed event associated with any plays of any games, such as in response to a tracked amount of coin-in reaching a threshold amount. In certain other embodiments, a bonus event triggering condition is satisfied based on a displayed event associated with a play of a game, such as the generation of a designated winning symbol combination.

In these embodiments, the triggered bonus event includes a plurality of individual bonus event component sequences. Each individual bonus event component sequence is associated with a plurality of time periods or windows including: (i) a bonus award ineligibility time period or window during which any wagers placed on any plays of any games by any players are not utilized to determine which players win any bonus awards, and (ii) a bonus award eligibility time period or window during which one or more wagers placed on one or more plays of one or more games by one or more players are utilized, at least in part, to determine which players win any bonus awards.

In certain embodiments, the bonus award eligibility time period of at least one bonus event component sequence at least partially overlaps with the bonus award ineligibility period of another bonus event component sequence such that a plurality of bonus event component sequences are simultaneously or concurrently activated. That is, prior to the conclusion of the bonus award eligibility time period for one or more bonus event component sequences, the gaming system triggers or activates the bonus award ineligibility time period for another bonus event component sequence such that at least two bonus event component sequences are overlappingly activated. Such a configuration provides that at at least one point in time of the bonus event, one or more wagers placed by one or more players are being accounted for in association with at least two different bonus event component sequences.

Following the satisfaction of a bonus event triggering condition, the gaming system activates or initiates a first bonus event component sequence of the triggered bonus event. For the activated first bonus event component sequence, the gaming system first initiates a bonus award ineligibility time period or window (i.e., an attract time window). During this bonus award ineligibility time period, the gaming system enables a plurality of players at a plurality of electronic gaming machines to place one or more wagers on one or more games In one such embodiment, these wagers contribute to the bonus award of the first bonus event component sequence, but are not utilized in determining which players win any bonus event awards associated with the activated bonus event component sequence. That is, while the wagers placed by the players at the electronic gaming machines during the attract time window of the activated bonus event component sequence are not employed to determine which player wins a bonus event award for that activated bonus event component sequence, the wagers placed by the players at the electronic gaming machines during the attract time window of the activated bonus event component sequence are employed to grow the bonus event award for that activated bonus event component sequence.

Following the conclusion of the bonus award ineligibility time period or window for the activated first bonus event component sequence, the gaming system initiates a bonus award eligibility time period or window (i.e., a winning time window). During this bonus award eligibility time period, the gaming system enables a plurality of players at a plurality of electronic gaming machines to place one or more wagers on one or more games, wherein such wagers contribute to the bonus award of the first bonus event component sequence and are utilized in determining which players win any bonus event awards associated with the activated bonus event component sequence. That is, the wagers placed by the players at the electronic gaming machines during the winning time window of the activated bonus event component sequence are employed to: (i) determine which player wins a bonus event award for that activated bonus event component sequence, and (ii) grow the bonus event award for that activated bonus event component sequence.

Following the conclusion of the bonus award eligibility time period, the gaming system selects one or more of the electronic gaming machines to provide one or more bonus event awards associated with the activated bonus event component sequence. In certain embodiments, the selection of the electronic gaming machine(s) to provide such bonus event award(s) occurs based on a displayed event associated with a play of a game. In certain other embodiments, the selection of the electronic gaming machine(s) to provide such bonus event award(s) occurs independent of any displayed event associated with any plays of any games. In one such embodiment, the gaming system determines which electronic gaming machine to select to provide a bonus event award to based on the respective relative total amounts wagered on each of the electric gaming machines during the bonus award eligibility time period of that bonus event component sequence. In this embodiment, for a bonus event component sequence, the gaming system determines the relative percentages of total amounts wagered for each of the electronic gaming machines by determining the amount wagered at each electronic gaming machine in relation to the total amount wagered at all electronic gaming machines during the bonus award eligibility time period for that bonus event component sequence. In this embodiment, the gaming system uses these relative percentages determined for each electronic gaming machine to randomly determine which of the electronic gaming machines will be selected to provide the bonus event award(s) for the activated bonus event component sequence. Accordingly, each electronic gaming machine associated with the placement of a designated wager amount on one or more plays of one or more games during the bonus award eligibility time period has a chance of being selected to provide a bonus award for the activated bonus event component sequence. It should be appreciated that in this embodiment, the electronic gaming machine which had the most amount wagered during the bonus award eligibility time period has the greatest relative percentage of total amounts wagered and thus has the highest chance of being selected to provide a bonus award for the activated bonus event component sequence.

Following providing one or more players one or more awards for the activated bonus event component sequence, the gaming system determines whether any other bonus event component sequences are currently activated (i.e., as a result of the above-described overlapping of the time periods of at least two bonus event component sequences) or remain to be activated.

If at least one other bonus event component sequence is currently activated, the gaming system proceeds with providing one or more players one or more awards for that activated bonus event component sequence as described above. If at least one bonus event component sequence remains to be activated (i.e., at least one bonus event component sequence of the triggered bonus event has not been previously activated by the gaming system), the gaming system activates the bonus award ineligibility time period of the remaining bonus event component sequence and proceeds with providing one or more players one or more awards for that bonus event component sequence as described above. On the other hand, if no bonus event component sequences remain inactivated (i.e., each of the bonus event component sequences of the triggered bonus event have concluded), the gaming system concludes the triggered bonus event and awaits for another triggering of another bonus event.

Accordingly, the gaming system and method disclosed herein enables a plurality of players to individually win one or more awards based on the occurrence of a single bonus event triggering event. Such a configuration increases the amount of excitement and enjoyment of certain players by providing these players the chance to win one or more bonus event awards regardless of whether these players are playing at the electronic gaming machine associated with the triggering of the bonus event.

Additional features and advantages are described in, and will be apparent from, the following Detailed Description and the figures.

BRIEF DESCRIPTION OF THE FIGURES

FIG. 3 is a chart of an example of the relative wagered amounts for three electronic gaming machines during a bonus award eligibility time period of a bonus event component sequence and the probability of being selected to provide a bonus award for each electronic gaming machine.

DETAILED DESCRIPTION

Multiple Winner Bonus Event

In various embodiments, the gaming system disclosed herein includes a bonus event associated with a bonus event time period or bonus event time window. The bonus event utilizes a plurality of bonus event component sequences, wherein each bonus event component sequence is associated with a plurality of time periods or windows which collectively (when accounting for any overlaps) forms the bonus event time period. In these embodiments, upon the triggering of the bonus event, the gaming system provides one or more awards in association with each bonus event component sequence. That is, for the single occurrence of a bonus event triggering event, the gaming system determines a plurality of winners for a plurality of different time periods that are each associated with the bonus event. Such a configuration of providing a plurality of awards over a plurality of time periods based on a single occurrence of a triggering event combats jackpot fatigue and provides an increased amount of excitement and enjoyment for certain players.

While the player's credit balance, the player's wager, and any awards are displayed as an amount of monetary credits or currency in certain of the embodiments described below, one or more of such player's credit balance, such player's wager, and any awards provided to such a player may be for non-monetary credits, promotional credits, and/or player tracking points or credits.

Figure 1:
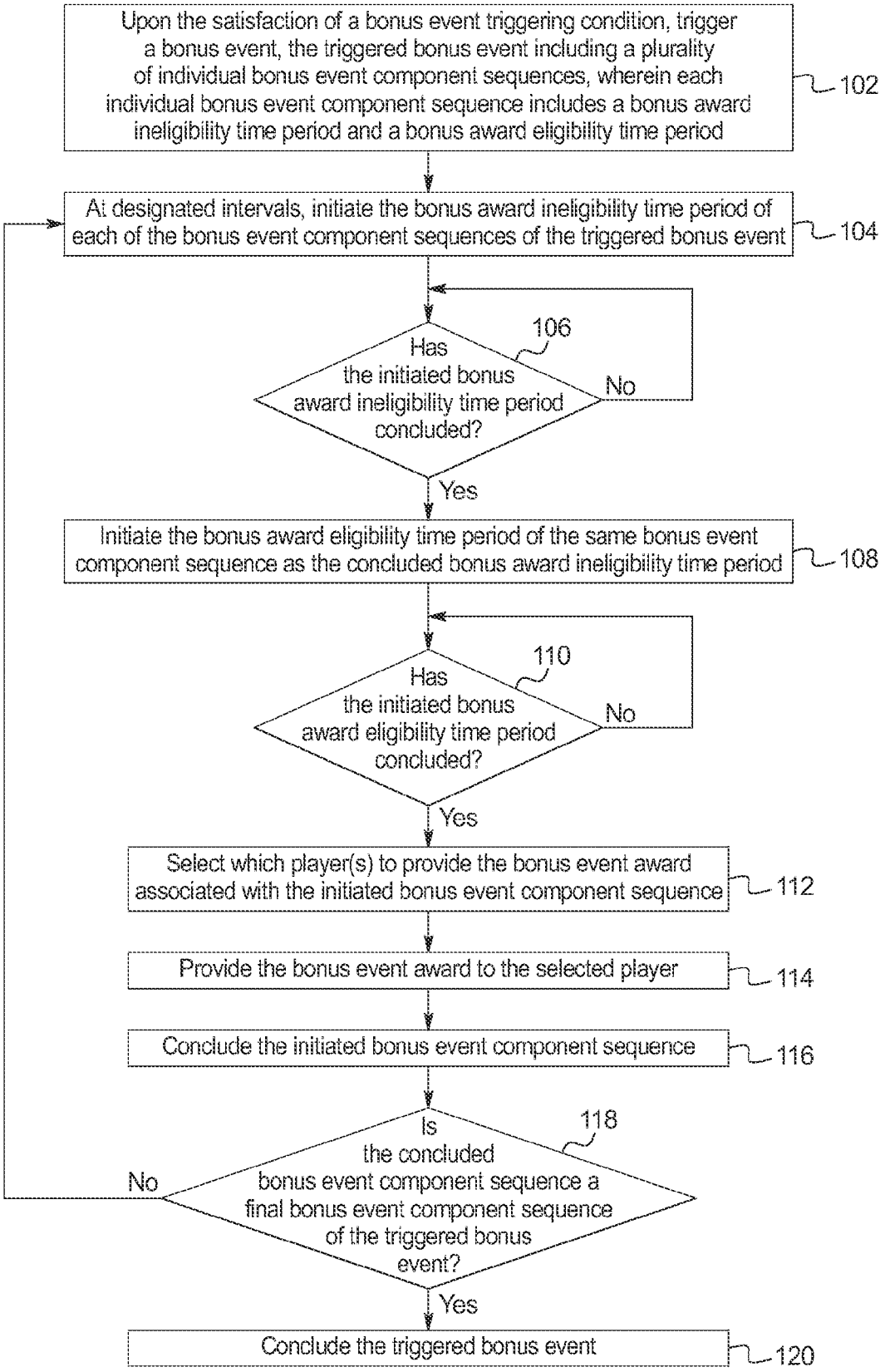
FIG. 1 is a flow chart an example process for operating a gaming system including a bonus event having a plurality of bonus event component sequences as disclosed herein.

Referring now to FIG. 1, a flowchart of an example embodiment of a process for operating a gaming system disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In operation of one embodiment of the gaming system disclosed herein, in addition to: (i) enabling one or more players to wager on one or more games (not shown), (ii) for each game played, generating and displaying an outcome (not shown), and (iii) for each game played, determining and displaying any award associated with the displayed outcome (not shown), upon the satisfaction of a bonus event triggering condition, the gaming system triggers a bonus event as indicated in block 102.

In one embodiment, a bonus event triggering condition is satisfied based on a displayed event in a play of one or more displayed games. In another embodiment, the gaming system tracks the occurrences of one or more suitable events occurring at or in association with one or more players and/or one or more games and determines, based on these tracked events, whether a bonus event triggering condition is satisfied. In another embodiment, the gaming system defines one or more game play parameters, wherein each time a player's tracked game play activity satisfies the defined parameter, the bonus event triggering condition is satisfied.

In another embodiment, a bonus event triggering condition is satisfied independent of any displayed event in any play of any game. In one such embodiment, the gaming system maintains a wager accumulation pool, wherein the gaming system allocates a portion of each wager placed (or each designated wager placed) to the maintained wager accumulation pool. In one such embodiment, the gaming system determines that a bonus event triggering condition is satisfied when the gaming system determines that the current value of the maintained wager accumulation pool has incremented to a wager accumulation pool trigger value or hit value. In another such embodiment, the gaming system determines that a bonus event triggering condition is satisfied when the gaming system determines that the current value of the maintained wager accumulation pool has incremented to within a suitable range of the wager accumulation pool trigger value or hit value.

Figure 2:
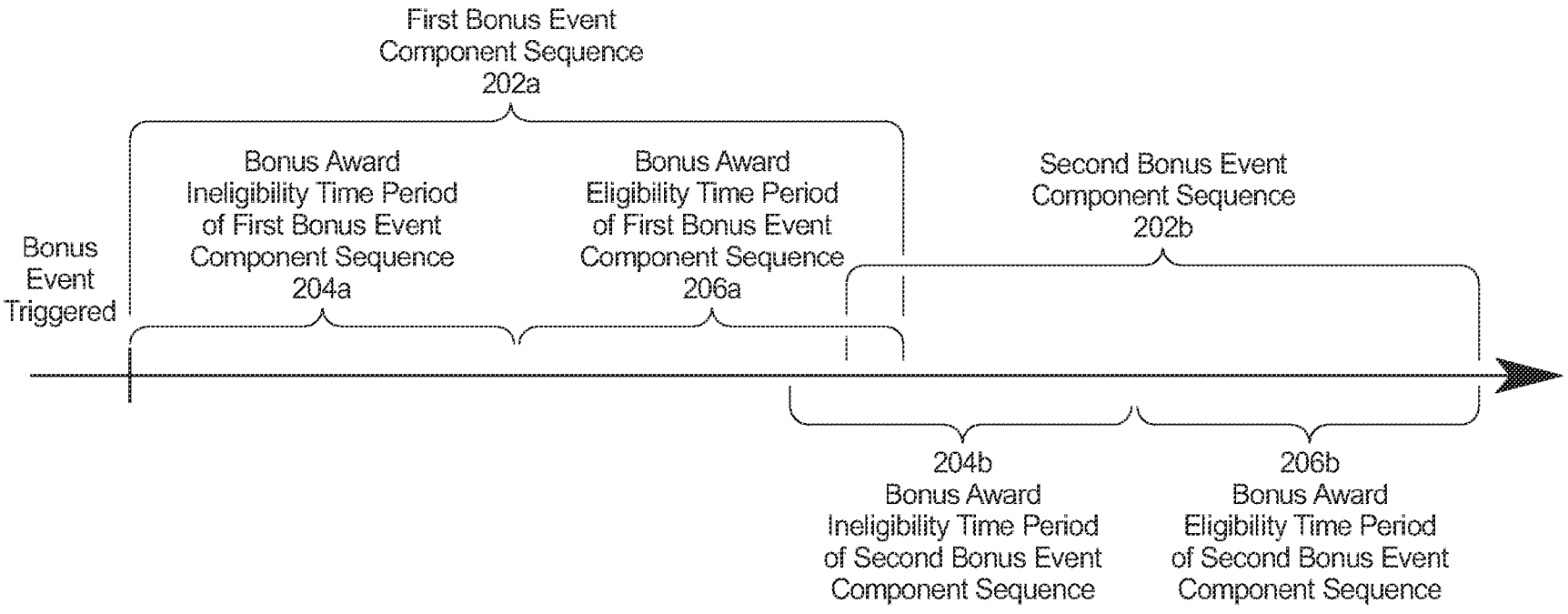
FIG. 2 is a timeline illustrating a plurality of different bonus event component sequence time periods of a triggered bonus event.

In one embodiment, as further indicated in block 102, the triggered bonus event includes a plurality of individual bonus event component sequences. In this embodiment, each individual bonus event component sequence is associated with a plurality of time periods or windows including: (i) a bonus award ineligibility time period or window, and (ii) a bonus award eligibility time period or window. In one example, as seen in FIG. 2, a triggered bonus event includes a first individual bonus event component sequence 202*a* and a second individual bonus event component sequence 202*b*. As seen in this example, the first bonus event component sequence includes a bonus award ineligibility time period 204*a* of ten seconds and a bonus award eligibility time period or window 206*a* of ten seconds. As further seen in this example, the second bonus event component sequence includes a bonus award ineligibility time period 204*b* of ten seconds and a bonus award eligibility time period or window 206*b* of ten seconds.

Returning to FIG. 1, following the triggering of the bonus event, the gaming system initiates or activates, at designated intervals, the bonus award ineligibility time periods of each of the bonus event component sequences of the triggered bonus event as indicated in block 104. That is, as the triggered bonus event is associated with a period of time and as the triggered bonus event includes a plurality of bonus event component sequences, the gaming system periodically activates the bonus event component sequences (and specifically periodically activates the bonus award ineligibility time periods of the bonus event component sequences) such that the triggered bonus event continues for the associated period of time.

In certain embodiments, the initiation or activation, at designated intervals, of the bonus award ineligibility time periods of each of the bonus event component sequences of the triggered bonus event provides that the bonus award eligibility time period of at least one bonus event component sequence at least partially overlaps with the bonus award ineligibility period of another bonus event component sequence. Put differently, this periodic initiation or activation of the bonus award ineligibility time periods of each of the bonus event component sequences of the triggered bonus event causes a plurality of bonus event component sequences to be simultaneously, concurrently or overlappingly activated. Such a configuration provides that at at least one point in time of the bonus event, one or more wagers placed by one or more players are being accounted for in association with at least two different bonus event component sequences.

For example, as seen in FIG. 2, for the triggered bonus event, the last five seconds of the bonus award eligibility time period or window 206*a* of the first bonus event component sequence 202*a* overlaps with the first five seconds of the bonus award ineligibility time period 204*b* of the second bonus event component sequence 202*b*. It should be appreciated that while this example includes bonus award ineligibility time periods of ten seconds, bonus award eligibility time periods of ten seconds and a five second overlap between time periods of different bonus event component sequences, any suitable amount of time of such time periods and/or such overlaps may be implemented in accordance with the present disclosure. It should be further appreciated that while this example includes bonus award ineligibility time periods and bonus award eligibility time periods of the same duration, different bonus award ineligibility time periods and/or different bonus award eligibility time periods may be of different durations.

In certain embodiments, during the bonus award ineligibility time period of a bonus event component sequence (i.e., during an attract time period), any wagers placed on any plays of any games by any players are not utilized to determine which players win any bonus awards. In one such embodiment, the gaming system utilizes any wagers placed on any plays of any games by any players during the bonus award ineligibility time period of a bonus event component sequence to fund one or more bonus event awards. In this embodiment, one or more wagers placed on one or more games during the bonus award ineligibility time period of a bonus event component sequence contribute to the bonus award of the initiated bonus event component sequence, but are not utilized in determining which players win any bonus event awards associated with the activated bonus event component sequence. That is, while the wagers placed by the players during the attract time window of the bonus event component sequence are not employed to determine which player wins a bonus event award for that bonus event component sequence, the wagers placed by the players during the attract time window of the bonus event component sequence are employed to grow the bonus event award.

Following the initiation of the bonus award ineligibility time period of one of the bonus event component sequences of the triggered bonus event, the gaming system determines, for each initiated bonus event component sequence, whether the initiated bonus award ineligibility time period has concluded as indicated in diamond 106.

If the gaming system determines that the initiated bonus award ineligibility time period has not concluded, the gaming system returns to diamond 106 and continues with determining, at designated intervals, whether the initiated bonus award ineligibility time period has concluded. On the other hand, if the gaming system determines that the initiated bonus award ineligibility time period has concluded, as indicated in block 108, the gaming system initiates the bonus award eligibility time period of the same bonus event component sequence as the concluded bonus award ineligibility time period.

In certain embodiments, during the bonus award eligibility time period of a bonus event component sequence (i.e., during a winning time period), any wagers placed on any plays of any games by any players are utilized to determine which players win any bonus awards. In one such embodiment, the gaming system utilizes any wagers placed on any plays of any games by any players during the bonus award eligibility time period of a bonus event component sequence to fund one or more bonus event awards. In this embodiment, one or more wagers placed on one or more games during the bonus award eligibility time period of a bonus event component sequence contribute to the bonus award of the initiated bonus event component sequence and are further utilized in determining which players win any bonus event awards associated with the activated bonus event component sequence. That is, the wagers placed by the players during the winning time window of the bonus event component sequence are employed to determine which player wins a bonus event award for that bonus event component sequence and are employed to grow the bonus event award.

Following the initiation of the bonus award eligibility time period of one of the bonus event component sequences of the triggered bonus event, the gaming system determines, for each initiated bonus event component sequence whether the initiated bonus award eligibility time period has concluded as indicated in diamond 110.

If the gaming system determines that the initiated bonus award eligibility time period has not concluded, the gaming system returns to diamond 110 and continues with determining, at designated intervals, whether the initiated bonus award eligibility time period has concluded. On the other hand, if the gaming system determines that the initiated bonus award eligibility time period has concluded, as indicated in block 112, the gaming system selects which player(s) to provide the bonus event award associated with the initiated bonus event component sequence.

In one embodiment, the gaming system determines which player(s) to provide the bonus event award associated with the initiated bonus event component sequence based on a displayed event in a play of one or more displayed games. In another embodiment, the gaming system tracks the occurrences of one or more suitable events occurring at or in association with one or more players and/or one or more games and determines, based on these tracked events, which player(s) to provide the bonus event award associated with the initiated bonus event component sequence. In another embodiment, the gaming system defines one or more game play parameters, wherein the gaming system determines which player(s) to provide the bonus event award associated with the initiated bonus event component sequence based on a player's tracked game play activity satisfying the defined parameter.

In another embodiment, the gaming system determines which player(s) to provide the bonus event award associated with the initiated bonus event component sequence independent of any displayed event in any play of any game. In one such embodiment, the gaming system determines which player(s) to provide the bonus event award associated with the initiated bonus event component sequence based on the respective relative total amounts wagered on each of the electric gaming machines during the bonus award eligibility time period of that bonus event component sequence. In this embodiment, for a bonus event component sequence, the gaming system determines the relative percentages of total amounts wagered for each of the electronic gaming machines by determining the amount wagered at each electronic gaming machine in relation to the total amount wagered at all electronic gaming machines during the bonus award eligibility time period for that bonus event component sequence. In this embodiment, the gaming system uses these relative percentages determined for each electronic gaming machine to randomly determine which of the electronic gaming machines will be selected to provide the bonus event award(s) for the activated bonus event component sequence.

For example, as seen in FIG. 3, (i) electronic gaming machine A wagered two-hundred-twenty credits during the bonus award eligibility time period of the bonus event component sequence, (ii) electronic gaming machine B wagered one-hundred-fifty-four credits during the bonus award eligibility time period of the bonus event component sequence, and (iii) electronic gaming machine B wagered sixty-six credits during the bonus award eligibility time period of the bonus event component sequence. In this example, based on the total of four-hundred-forty credits being wagered during the bonus award eligibility time period of the bonus event component sequence, the gaming system determines: (i) electronic gaming machine A has a 50% (or 220/440) of being selected to win the bonus event award of the bonus event component sequence, (ii) electronic gaming machine B has a 35% (or 154/440) of being selected to win the bonus event award of the bonus event component sequence, and (iii) electronic gaming machine C has a 15% (or 66/440) of being selected to win the bonus event award of the bonus event component sequence. In this example, the gaming system determines the electronic gaming machine to provide the bonus event award of the bonus event component sequence based on these probabilities using a random number generator or random number generating algorithm.

As seen in this example, each electronic gaming machine associated with the placement of a designated wager amount on one or more plays of one or more games during the bonus award eligibility time period has a chance of being selected to provide a bonus award for the activated bonus event component sequence. As further seen in this example, the electronic gaming machine which had the most amount wagered during the bonus award eligibility time period has the greatest relative percentage of total amounts wagered and thus has the highest chance of being selected to provide a bonus award for the activated bonus event component sequence.

It should be appreciated that, as described above, the credits wagered during the bonus event ineligibility time period of a bonus event component sequence are not employed to determine each player's probability of winning a bonus award. For example, as seen in FIG. 3, while Player B had the most amount of credits wagered during the bonus event ineligibility time period (and the most amount of credits wagered during the total time period of this bonus event component sequence), since only the credits wagered during the bonus event eligibility time period are utilized in this example, Player B did not have the highest relative probability of winning a bonus award for this bonus event component sequence.

Returning to FIG. 1, following the determination of which player(s) to provide the bonus event award associated with the initiated bonus event component sequence, the gaming system provides the bonus event award to the selected player and concludes the initiated bonus event component sequence as indicated in blocks 114 and 116.

In one embodiment, the gaming system provides the same bonus award (or bonus awards within a designated range) for each bonus event component sequence. In one such embodiment, the gaming system maintains a bonus event award, such as a progressive award, wherein the gaming system provides the same portion (or portions within a designated range) of the maintained bonus event award for each bonus event component sequence. In another embodiment, the gaming system provides different bonus awards for two or more bonus event component sequences. In one such embodiment, the gaming system maintains a bonus event award, such as a progressive award, wherein the gaming system provides different portions of the maintained bonus event award for at least two bonus event component sequences. For example, the player selected to win the bonus award of a first bonus event component sequence is provided 40% of the bonus event award and the player selected to win the bonus award of a second bonus event component sequence is provided 60% of the bonus event award.

In different embodiments, the bonus award(s) provided in association with one or more bonus event component sequences include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

In another embodiment, the bonus award(s) provided in association with one or more bonus event component sequences includes triggering or unlocking one or more features otherwise unavailable to the player. In different embodiments, the gaming system selects such feature(s) from the group of features including, but not limited to:

(i) a book-end wild symbols feature;
(ii) a stacked wild symbols feature;
(iii) an expanding wild symbols feature;
(iv) a wild reel feature;
(v) a retrigger symbol feature;
(vi) an anti-terminator symbol feature;
(vii) a locking reel feature, (viii) a locking symbol position feature;
(ix) a modification of an amount of credits of a credit balance;
(x) a modification of an amount of promotional credits;
(xi) a modification of a placed wager amount;
(xii) a modification of a wager amount available to be placed;
(xiii) a modification of a placed side wager amount;
(xiv) a modification of a side wager amount available to be placed;
(xv) a modification of a rate of earning player tracking points;
(xvi) a modification of a number of wagered on paylines;
(xvii) a modification of a number of paylines available to be wagered on;
(xviii) a modification of a wager placed on one or more paylines (or on one or more designated paylines);
(xix) a modification of a number of ways to win wagered on;
(xx) a modification of a number of available ways to win to be wagered on;
(xxi) a modification of a wager placed on one or more ways to win (or on one or more designated ways to win);
(xxii) a modification of a paytable utilized for a play of a game;
(xxiii) an application of a modifier, such as a multiplier or an additional quantity of credits, to one or more awards of a paytable utilized for a play of a game,
(xxiv) a modification of an average expected payback percentage of a play of a game;
(xxv) a modification of an average expected payout of a play of a game;
(xxvi) a modification of one or more awards available;
(xxvii) a modification of a range of awards available;
(xxviii) a modification of a type of awards available;
(xxix) a modification of one or more progressive awards;
(xxx) a modification of which progressive awards are available to be won;
(xxxi) a modification of one or more modifiers, such as multipliers, available;
(xxxii) a modification of an activation of a reel (or a designated reel);
(xxxiii) a modification of an activation of a plurality of reels;
(xxxiv) a modification of a generated outcome (or a designated generated outcome);
(xxxv) a modification of a generated outcome (or a designated generated outcome) associated with an award over a designated value;
(xxxvi) a modification of a generated outcome (or a designated generated outcome) on a designated payline;
(xxxvii) a modification of a generated outcome (or a designated generated outcome) in a scatter configuration;
(xxxviii) a modification of a winning way to win (or a designated winning way to win);
(xxxix) a modification of a designated symbol or symbol combination;
(xl) a modification of a generation of a designated symbol or symbol combination on a designated payline;
(xli) a modification of a generation of a designated symbol or symbol combination in a scatter configuration;
(xlii) a modification of a triggering event of a play of a secondary or bonus game;
(xlii) a modification of an activation of a secondary or bonus display (such as an award generator);
(xliv) a modification of an activation of a community award generator;
(xlv) a modification of a generated outcome (or a designated generated outcome) in a secondary game;
(xlvi) a modification of an amount of free spins provided;
(xlvii) a modification of a game terminating or ending condition;
(xlviii) a modification of how one or more aspects of one or more games (e.g., colors, speeds, sound) are displayed to a player;
(xlix) a modification of access to different websites a team member may access via a mobile device;
(l) a modification of audio-visual content a team member may access via a mobile device
(li) a modification of any game play feature associated with any play of any game disclosed herein;
(lii) a modification of a player's avatar;
(lii) a play of any suitable slot game;
(liv) a play of any suitable free spins or free game activations;
(lv) a play of any suitable wheel game;
(lvi) a play of any suitable card game;
(lvii) a play of any suitable offer and acceptance game;
(lviii) a play of any suitable award ladder game;
(lix) a play of any suitable puzzle-type game;
(lx) a play of any suitable persistence game;
(lxi) a play of any suitable selection game;
(lxii) a play of any suitable cascading symbols game;
(lxiii) a play of any suitable ways to win game;
(lxiv) a play of any suitable scatter pay game;
(lxv) a play of any suitable coin-pusher game;
(lxvi) a play of any suitable elimination game;
(lxvii) a play of any suitable stacked wilds game;
(lxviii) a play of any suitable trail game;
(lxix) a play of any suitable bingo game;
(lxx) a play of any suitable video scratch-off game;
(lxxi) a play of any suitable pick-until-complete game;
(lxxii) a play of any suitable shooting simulation game;
(lxxiii) a play of any suitable racing game;
(lxxiv) a play of any suitable promotional game;
(lxxv) a play of any suitable high-low game;
(lxxvi) a play of any suitable lottery game;
(lxxvii) a play of any suitable number selection game;
(lxxviii) a play of any suitable dice game;
(lxxix) a play of any suitable skill game;
(lxxx) a play of any suitable auction game;
(lxxxi) a play of any suitable reverse-auction game;
(lxxxii) a play of any suitable group game;
(lxxxiii) a play of any suitable game in a service window;
(lxxxiv) a play of any suitable game on a mobile device; and/or
(lxxxv) a play of any other suitable type of game.

Returning to FIG. 1, following the conclusion of the bonus event component sequence, the gaming system determines whether the concluded bonus event component sequence is a final bonus event component sequence of the triggered bonus event as indicated in diamond 118.

If the concluded bonus event component sequence is not the final bonus event component sequence of the triggered bonus event, the gaming system returns to block 104 and awaits the periodic initiation or activation of another bonus award ineligibility time period of another bonus event component sequence of the triggered bonus event. That is, if at least one bonus event component sequence of the triggered bonus event remains unplayed, the gaming system awaits for another bonus event component sequence of the triggered bonus event to be played. On the other hand, if the concluded bonus event component sequence is the final bonus event component sequence of the triggered bonus event, the gaming system concludes the triggered bonus event as indicated in block 120.

In one embodiment, the gaming system causes at least one display device of at least one electronic gaming machine to display the triggered bonus event. In another embodiment, in addition or in alternative to each electronic gaming machine displaying the triggered bonus event, the gaming system causes one or more community or overhead display devices to display part or all of the triggered bonus event to one or more other players or bystanders either at a gaming establishment or viewing over a network, such as the internet. In another embodiment, in addition or in alternative to each electronic gaming machine displaying the triggered bonus event, the gaming system causes one or more internet sites to each display the triggered bonus event such that a player is enabled to log on from a personal web browser. In another such embodiment, the gaming system enables the player to play one or more games on one device while viewing the triggered bonus event from another device, such as a desktop or laptop computer.

In different embodiments, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences, based on an outcome associated with one or more plays of any primary game and/or an outcome associated with one or more plays of any secondary game of the electronic gaming machines in the gaming system. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In different embodiments, the gaming system does not provide any apparent reasons to the players for the satisfaction of a bonus event triggering condition, the initiation and/or conclusion of one or more bonus award ineligibility time periods of one or more bonus event component sequences, the initiation or conclusion of one or more bonus award eligibility time periods of one or more bonus event component sequences and/or the selection of one or more players to be provided one or more bonus awards of one or more bonus event component sequences. In these embodiments, such determinations are not triggered by an event in a primary game or based specifically on any of the plays of any primary game or on any of the plays of any secondary game of the electronic gaming machines in the system. That is, these conditions are satisfied and these events occur without any explanation or alternatively with simple explanations.

In one such embodiment, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences based on an amount of coin-in. In this embodiment, the gaming system determines if an amount of coin-in wagered reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In different embodiments, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences, based on a predefined variable reaching a defined parameter threshold. For example, when the 500,000$^{th}$ player has played an electronic gaming machine of the gaming system (ascertained from a player tracking system), one or more of such events or conditions occur. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In different embodiments, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences, based on a quantity of games played. In this embodiment, a quantity of games played is set for when one or more of such events or conditions will occur. In one embodiment, such a set quantity of games played is based on historic data.

In different embodiments, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences, based on time. In this embodiment, a time is set for when one or more of such events or conditions will occur. In one embodiment, such a set time is based on historic data.

In different embodiments, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences, based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences, based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments, a bonus event triggering condition is satisfied, one or more bonus award ineligibility time periods of one or more bonus event component sequences are initiated and/or concluded, one or more bonus award eligibility time periods of one or more bonus event component sequences are initiated and/or concluded, and/or one or more players are selected to be provided one or more bonus awards of one or more bonus event component sequences, based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a bonus event triggering condition to be satisfied, one or more bonus award ineligibility time periods of one or more bonus event component sequences to be initiated and/or concluded, one or more bonus award eligibility time periods of one or more bonus event component sequences to be initiated and/or concluded, and/or one or more players to be selected to be provided one or more bonus awards of one or more bonus event component sequences occur may be implemented in accordance with the gaming system and method disclosed herein.

It should be appreciated that one or more of the above-described triggers pertaining to the satisfaction of a bonus event triggering condition, the initiation and/or conclusion of one or more bonus award ineligibility time periods of one or more bonus event component sequences, the initiation or conclusion of one or more bonus award eligibility time periods of one or more bonus event component sequences and/or the selection of one or more players to be provided one or more bonus awards of one or more bonus event component sequences may be combined in one or more different embodiments.

Alternative Embodiments

It should be appreciated that in different embodiments, one or more of:

i. when to trigger a bonus event;
ii. which triggering condition to associate with a bonus event;
iii. a quantity of bonus event component sequences of a bonus event;
iv. when to initiate a bonus award ineligibility time period of a triggered bonus event component sequence;
v. when to conclude a bonus award ineligibility time period of a triggered bonus event component sequence;
vi. when to initiate a bonus award eligibility time period of a triggered bonus event component sequence;
vii. when to conclude a bonus award eligibility time period of a triggered bonus event component sequence;
viii. a duration of a bonus award ineligibility time period of a triggered bonus event component sequence;
ix. a duration of a bonus award eligibility time period of a triggered bonus event component sequence;
x. an amount of the bonus event award to provide to the winning player of each bonus event component sequence;
xi. a percentage of a bonus event award to provide to the winning player of each bonus event component sequence;
xii. a quantity of bonus event awards to provide for each bonus event component sequence; and/or
xii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
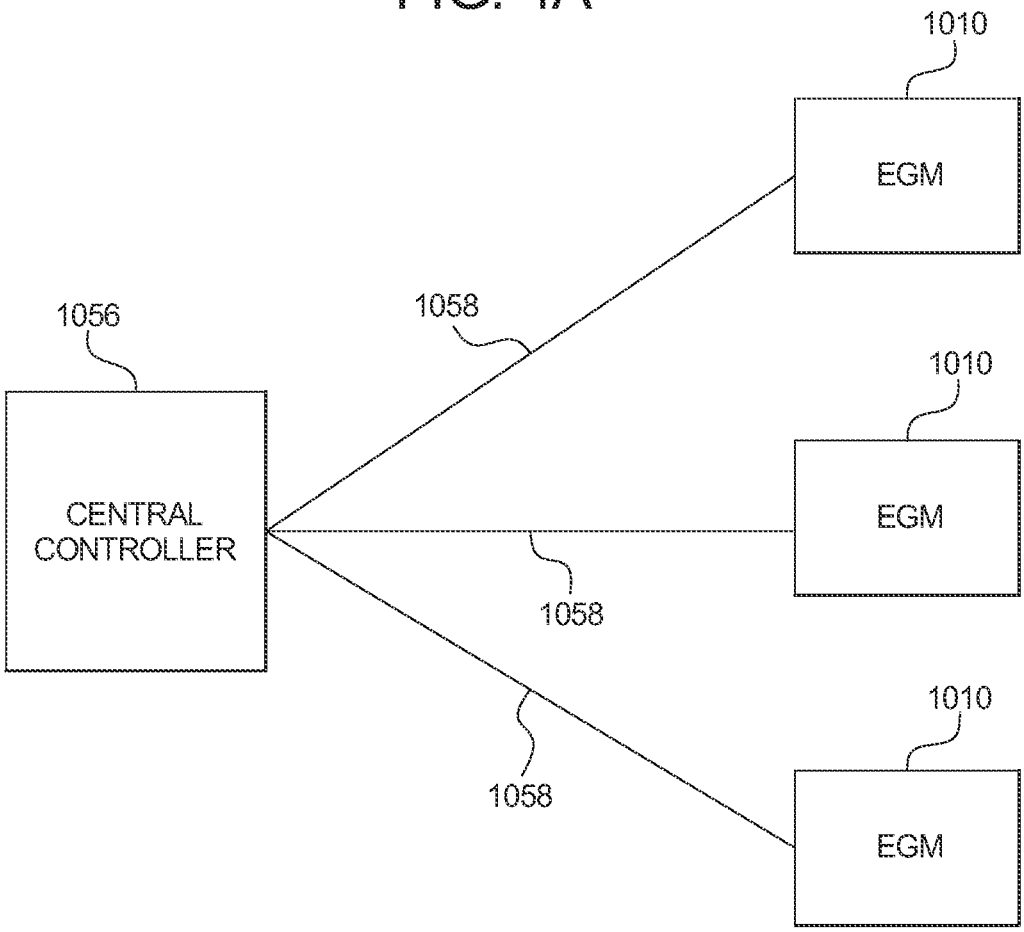
FIG. 4A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
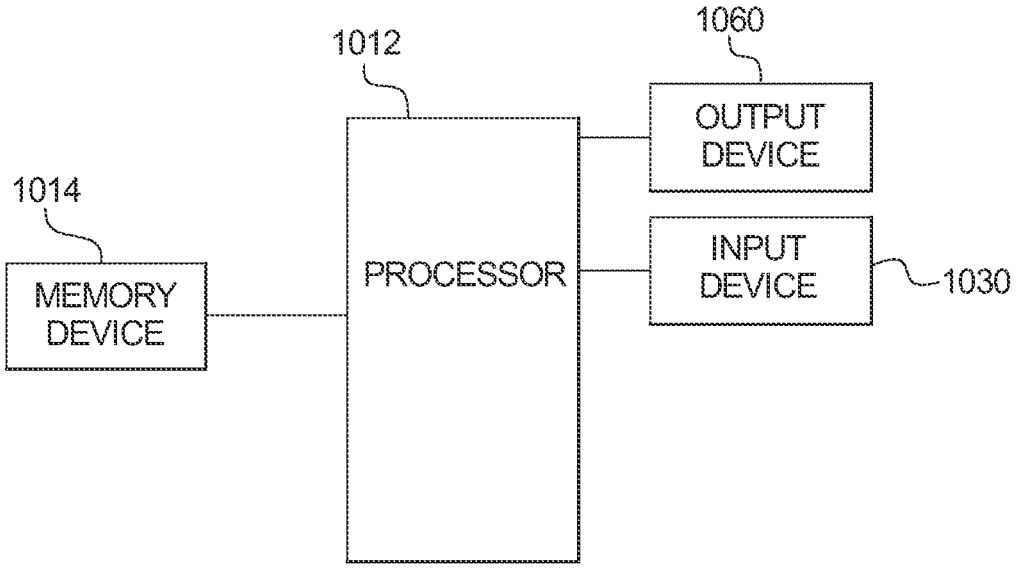
FIG. 4B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
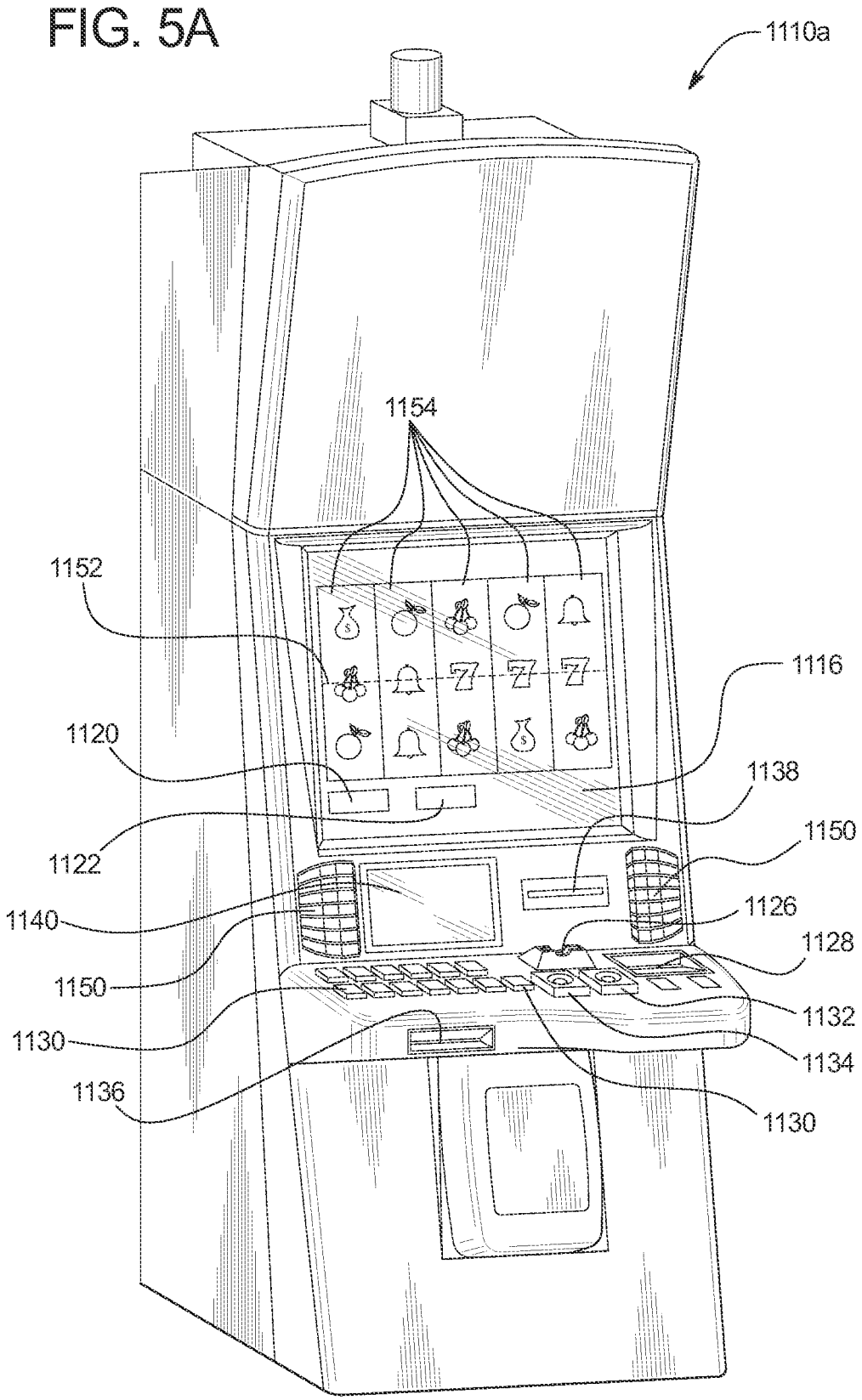
FIGS. 5A and 5B are perspective views of example alternative embodiments of the gaming system disclosed herein.
Figure 5B:
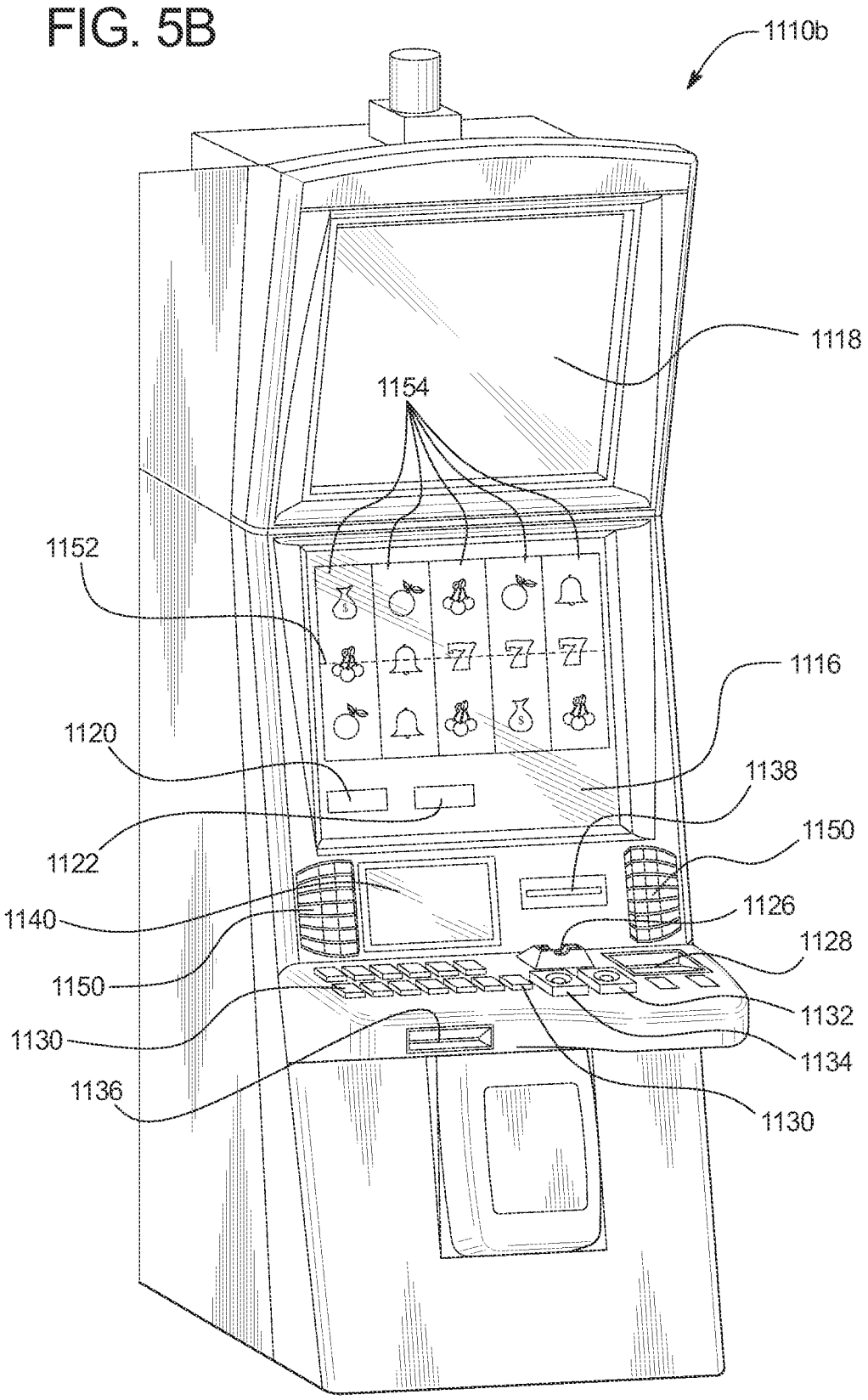

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 43 includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 53 includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements.

As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system server comprising:

at least one processor, and at least one memory device which stores a plurality of instructions, which when executed by the at least one processor, cause the at least one processor to:

(a) receive data associated with a placement of a wager amount on a play of a game, wherein a credit balance is decreasable based on the wager amount placed on the play of the game, said credit balance being increasable via an acceptor of a physical item associated with a monetary value, and said credit balance being decreasable in association with a cashout input received via a cashout device, (b) determine a game outcome, (c) cause at least one display device to display the determined game outcome, (d) determine any award associated with the displayed game outcome, (e) cause the at least one display device to display any determined award, wherein said credit balance is increasable based on any determined award, (f) trigger a bonus event, said bonus event including a plurality of sequentially activated bonus event component sequences, and (g) for each of the plurality of sequentially activated bonus event component sequences of the triggered bonus event:

(i) track any wager amounts placed by any players on any plays of any games during a bonus event ineligibility time period, (ii) track any wager amounts placed by any players on any plays of any games during a subsequent bonus event eligibility time period, (iii) upon the conclusion of the bonus award eligibility time period, select one of the players, said selection being based on the tracked wagered amounts for each player during the bonus award eligibility time period relative to a total tracked wager amount for all players during the bonus award eligibility time period, and said selection not being based on any wagers placed by any players during the bonus award ineligibility time period, and (iv) cause the selected player to be provided a bonus award associated with the bonus event component sequence, wherein said credit balance is increasable based on the bonus award associated with the bonus event component sequence.

2. The gaming system server of claim 1, wherein at part a portion of the bonus award eligibility time period of one activated bonus event component sequence overlaps with at least a portion of the bonus award ineligibility time period of another subsequently activated bonus event component sequence.

3. The gaming system server of claim 1, wherein different bonus event component sequences are associated with different bonus awards.

4. The gaming system server of claim 1, wherein the bonus event triggering condition is satisfied if an accumulated wager pool reaches a threshold amount.

5. The gaming system server of claim 1, wherein when executed by the at least one processor, the plurality of instructions cause the at least one processor to allocate to the bonus award associated with one of the bonus event component sequences at least one of: a portion of any wagers placed by any players during the bonus award ineligibility time period of said bonus event component sequence, and a portion of any wagers placed by any players during the bonus award eligibility time period of said bonus event component sequence.

6. The gaming system server of claim 1, wherein at least one of the bonus awards associated with at least one of the bonus event component sequences is one selected from the group of: a progressive award, a portion of a progressive award, a quantity of monetary credits, a quantity of non-monetary credits, a quantity of promotional credits, and a quantity of player tracking points.

7. A gaming system comprising:

a plurality of gaming machines, each gaming machine including:

a housing;

a plurality of input devices supported by the housing, said plurality of input devices including:

(i) an acceptor, and (ii) a cashout device, at least one display device supported by the housing, at least one processor, and at least one memory device which stores a plurality of instructions, which when executed by the at least one processor, cause the at least one processor to operate with the plurality of input devices and the at least one display device to:

(i) if a physical item is received via the acceptor establish a credit balance based, at least in part, on a monetary value associated with the received physical item, (ii) enable a player to place a wager amount on a play of a game, (iii) determine a game outcome, (iv) display the determined game outcome, (v) determine any award associated with the displayed game outcome, (vi) display any determined award, wherein said credit balance is increasable based on any determined award, and (vii) if a cashout input is received via the cashout device, cause an initiation of any payout associated with the credit balance a controller configured to operate with the plurality of gaming machines and programmed to, if a bonus event triggering condition is satisfied:

(a) trigger a bonus event, said bonus event including a plurality of sequentially activated bonus event component sequences, and (b) for each of the plurality of sequentially activated bonus event component sequence of the triggered bonus event:

(i) track any wager amounts placed by any players on any plays of any games during a bonus event ineligibility time period, (ii) track any wager amounts placed by any players on any plays of any games during a subsequent bonus event eligibility time period, (iii) upon the conclusion of the bonus award eligibility time period, select one of the players, said selection being based on the tracked wagered amounts for each player during the bonus award eligibility time period relative to a total tracked wager amount for all players during the bonus award eligibility time period, and said selection not being based on any wagers placed by any players during the bonus award ineligibility time period, and (iv) cause the selected player to be provided a bonus award associated with the bonus event component sequence, wherein said credit balance is increasable based on the bonus award associated with the bonus event component sequence.

8. The gaming system of claim 7, wherein at part a portion of the bonus award eligibility time period of one activated bonus event component sequence overlaps with at least a portion of the bonus award ineligibility time period of another subsequently activated bonus event component sequence.

9. The gaming system of claim 7, wherein different bonus event component sequences are associated with different bonus awards.

10. The gaming system of claim 7, wherein the bonus event triggering condition is satisfied if an accumulated wager pool reaches a threshold amount.

11. The gaming system of claim 7, wherein the controller is programmed to allocate to the bonus award associated with one of the bonus event component sequences at least one of: a portion of any wagers placed by any players during the bonus award ineligibility time period of said bonus event component sequence, and a portion of any wagers placed by any players during the bonus award eligibility time period of said bonus event component sequence.

12. The gaming system of claim 7, wherein at least one of the bonus awards associated with at least one of the bonus event component sequences is one selected from the group of: a progressive award, a portion of a progressive award, a quantity of monetary credits, a quantity of non-monetary credits, a quantity of promotional credits, and a quantity of player tracking points.

13. A method of operating a gaming system including a plurality of gaming machines, said method comprising:

(a) for each of the gaming machines:

(i) enabling a player to place a wager amount on a play of a game, wherein a credit balance is decreasable based on the wager amount placed on the play of the game, said credit balance being increasable via an acceptor of a physical item associated with a monetary value, and said credit balance being decreasable in association with a cashout input received via a cashout device, (ii) causing at least one processor to execute a plurality of instructions to determine a game outcome, (iii) causing at least one display device to display the determined game outcome, (iv) causing the at least one processor to execute the plurality of instructions to determine any award associated with the displayed game outcome, and (v) causing the at least one display device to display any determined award, wherein said credit balance is increasable based on any determined award, and (b) if a bonus event triggering condition is satisfied:

(i) causing a controller to execute a plurality of instructions to trigger a bonus event, said bonus event including a plurality of sequentially activated bonus event component sequences, and (ii) for each of the plurality of sequentially activated bonus event component sequence of the triggered bonus event:

(A) causing the controller to execute the plurality of instructions to track any wager amounts placed by any players on any plays of any games during a bonus event ineligibility time period, (B) causing the controller to execute the plurality of instructions to track any wager amounts placed by any players on any plays of any games during a subsequent bonus event eligibility time period, (C) upon the conclusion of the bonus award eligibility time period, causing the controller to execute the plurality of instructions to select one of the players, said selection being based on the tracked wagered amounts for each player during the bonus award eligibility time period relative to a total tracked wager amount for all players during the bonus award eligibility time period, and said selection not being based on any wagers placed by any players during the bonus award ineligibility time period, and (D) causing the selected player to be provided a bonus award associated with the bonus event component sequence, wherein said credit balance is increasable based on the bonus award associated with the bonus event component sequence.

14. The method of claim 13, wherein at part a portion of the bonus award eligibility time period of one activated bonus event component sequence overlaps with at least a portion of the bonus award ineligibility time period of another subsequently activated bonus event component sequence.

15. The method of claim 13, wherein different bonus event component sequences are associated with different bonus awards.

16. The method of claim 13, wherein the bonus event triggering condition is satisfied if an accumulated wager pool reaches a threshold amount.

17. The method of claim 13, which includes causing the controller to execute the plurality of instructions to allocate to the bonus award associated with one of the bonus event component sequences at least one of: a portion of any wagers placed by any players during the bonus award ineligibility time period of said bonus event component sequence, and a portion of any wagers placed by any players during the bonus award eligibility time period of said bonus event component sequence.

18. The method of claim 13, wherein at least one of the bonus awards associated with at least one of the bonus event component sequences is one selected from the group of: a progressive award, a portion of a progressive award, a quantity of monetary credits, a quantity of non-monetary credits, a quantity of promotional credits, and a quantity of player tracking points.

19. The method of claim 13, which is provided through a data network.

20. The method of claim 19, wherein the data network is an internet.

* * * * *